US007121350B2

(12) United States Patent
Aldridge et al.

(10) Patent No.: US 7,121,350 B2
(45) Date of Patent: Oct. 17, 2006

(54) TORQUE ANCHOR

(75) Inventors: Colin A. Aldridge, Okotoks (CA); Fritz Jagert, Langdon (CA)

(73) Assignee: Sampwell Testing Services LTD C/O/B/A Progressive Technology, Calgary (CA)

( * ) Notice: Subject to any disclaimer, the term of this patent is extended or adjusted under 35 U.S.C. 154(b) by 92 days.

(21) Appl. No.: 10/796,617

(22) Filed: Mar. 9, 2004

(65) Prior Publication Data

US 2005/0139361 A1 Jun. 30, 2005

(30) Foreign Application Priority Data

Dec. 24, 2003 (CA) ..... 2454227

(51) Int. Cl.
*E21B 23/01* (2006.01)

(52) U.S. Cl. ..... 166/382; 166/117.7; 166/210; 166/215; 166/216

(58) Field of Classification Search ..... None
See application file for complete search history.

(56) References Cited

U.S. PATENT DOCUMENTS

| | | | | |
|---|---|---|---|---|
| 2,665,888 | A | 1/1954 | Claypool et al. | |
| 2,930,327 | A | 3/1960 | Linkous | |
| 3,556,216 | A | 1/1971 | Condra | |
| 4,363,359 | A | 12/1982 | Taylor et al. | |
| 4,901,793 | A | 2/1990 | Weber | |
| 5,275,239 | A | 1/1994 | Obrejanu | |
| 6,062,309 | A * | 5/2000 | Gosse | 166/216 |
| 6,085,837 | A | 7/2000 | Massinon et al. | |
| 6,155,346 | A | 12/2000 | Aldridge | |
| 6,318,459 | B1 * | 11/2001 | Wright et al. | 166/117.6 |

FOREIGN PATENT DOCUMENTS

| | | |
|---|---|---|
| CA | 2088757 | 2/1993 |
| CA | 2227057 | 5/1997 |
| CA | 2241358 | 6/1998 |
| CA | 2310198 | 5/2000 |

* cited by examiner

*Primary Examiner*—Zakiya W. Bates
(74) *Attorney, Agent, or Firm*—Jason A. Bernstein; Powell Goldstein LLP

(57) ABSTRACT

An anchor to inhibit rotation of a device relative to an oil well casing, comprising a tubular mandrel adapted for direct or indirect connection to the device; a rotatable cylindrical housing with a plurality of apertures and able to receive at least a portion of the mandrel concentrically therethrough; a plurality of spaced apart anchoring slips disposed between the housing and the mandrel in registry with respective ones of the apertures in the housing's outer surface; a rotation mechanism associated with the mandrel to engage and then move respective ones of the anchoring slips radially towards and then into temporarily anchoring contact with the casing; and one or more drag blocks disposed in the housing in registry with respective ones of the apertures in the housing's outer surface to extend radially outwardly therefrom, each of the drag blocks being normally biased into frictional contact with the casing.

26 Claims, 4 Drawing Sheets

TORQUE ANCHOR

BACKGROUND OF THE INVENTION

Progressing cavity pumps are in increasingly common use in the oil field for production of formation fluids to the surface. The pumps comprise a fixed outer body usually referred to as a stator which connects to the production tubing in the well. Within the stator is a rotating inner component called a rotor which in cooperation with the stator pumps the formation fluids.

The rotor is rotated by a string of drive rods that transmit torque from a prime mover at the well head. The prime mover is normally an electric motor that produces up to 100 horsepower and also generates very substantial torque. The drive rods extend from a drive head at the top of the well head down through the production tubing to the rotor.

The inside of the stator is rubber and friction is generated as the rotor spins. If the stator is not properly anchored, it will rotate in the clockwise direction (to the "right" when viewed from above) and if not checked, the tubing joints will eventually loosen and part, allowing the tool to fall to the bottom of the well. Production must then be halted until the pump is fished out. To prevent this, pump anchors are used which, when engaged against the well casing, restrict right-handed rotation of the pump.

The problem however is that the drive rods themselves store a considerable amount of energy in the form of twist. In fact, after the motor is turned on the rods might twist as many as 50 times before the stator begins to turn.

When the motor is stopped, the rods untwist to release their stored torque, and the release can be violent, made worse by the weight of the oil in the tubing from the pump to the surface, resulting in speeds approaching 20,000 rpm. Because the pump anchor has become unset in response to the counterclockwise (to the "left") unwinding of the rods, the pump is unrestrained and whips around inside the well casing causing major damage to the pump and everything in its vicinity. The torque can also wildly spin the sheaves and pulleys that deliver torque from the motor to the drive rods which can cause additional failures and endanger anyone close by.

There are some anchors that are intended to restrain both left and right handed torque but these are typically "one set" or limited set devices and are usually referred to as "tension set anchors". They must be recovered to the surface then refaced or redressed after each use, which limits their utility.

SUMMARY OF THE INVENTION

It is therefore a feature of the present invention to provide a torque anchor which obviates and mitigates from the disadvantages of the prior art.

It is a further feature of the present invention to provide an anchor that restrains torque in both the left and right handed directions.

It is yet another feature of the present invention to provide an anchor that can be used repeatedly between rebuilds.

According to one exemplary embodiment of the present invention, there is provided an anchor to inhibit rotation of a device relative to an oil well casing, comprising a tubular mandrel adapted for direct or indirect connection to the device; a cylindrical housing to receive at least a portion of said mandrel concentrically therethrough, said housing being rotatable relative to said mandrel and having a plurality of circumferentially spaced apart apertures formed in an outer surface thereof; a plurality of spaced apart anchoring slips disposed between said housing and said mandrel in registry with respective ones of said apertures in said housing's outer surface; first biassing means associated with said mandrel for rotation therewith in the clockwise or counterclockwise directions to engage and then move respective ones of said anchoring slips radially towards and then into temporarily anchoring contact with the casing to prevent further rotation of said mandrel and the device connected thereto in either of said clockwise or counterclockwise directions; and one or more drag block means disposed in said housing in registry with respective ones of said apertures in said housing's outer surface to extend radially outwardly therefrom, each of said drag block means being normally biassed into frictional contact with said casing to inhibit rotation of said housing relative to the casing.

According to another aspect of the present invention, there is provided a torque anchor for use in an oil well to temporarily prevent rotation of a device connected to the anchor in the clockwise or counterclockwise directions, or both, comprising a tubular mandrel operatively connected to the device to be anchored; a plurality of casing gripping anchor members disposed in spaced apart relationship about the circumference of said mandrel; a housing mounted concentrically around at least a portion of said mandrel to be rotatable thereon and to at least partially contain said anchor members therein, said anchor members being mounted in said housing for rotation therewith around the mandrel and for radial movement towards and away from said mandrel; cam means on said mandrel for operatively engaging respective ones of said anchor members to bias them towards and into gripping contact with said casing upon rotation of said mandrel in one direction, and to operatively engage another of said anchor members upon rotation of said mandrel in the opposition direction, whereby gripping of the casing by said anchor members effectively stops the rotation of said mandrel; and a plurality of friction members supported by said housing normally biassed into contact with the casing to stop rotation of said housing relative to the casing.

According to a further aspect of the present invention, there is provided a method for anchoring a device against rotation in a well bore, comprising the steps of non-rotatably connecting the device to a mandrel disposed either above or below the device; surrounding at least a portion of the mandrel with a cylindrical housing that is rotatable relative to said mandrel, said housing having associated therewith a first set of anchor members normally biassed into frictional contact with the well bore to hold the housing stationary relative thereto, and a second set of anchor members actuatable in response to rotation of said mandrel for movement between a first retracted position and a second well bore gripping position, wherein gripping of the well by said second set of anchor members prevents further rotation of said mandrel.

BRIEF DESCRIPTION OF THE DRAWINGS

Exemplary embodiments of the invention will now be described in greater detail and will be better understood when read in conjunction with the following drawings in which.

DETAILED DESCRIPTION OF THE EMBODIMENTS

Figure 1:
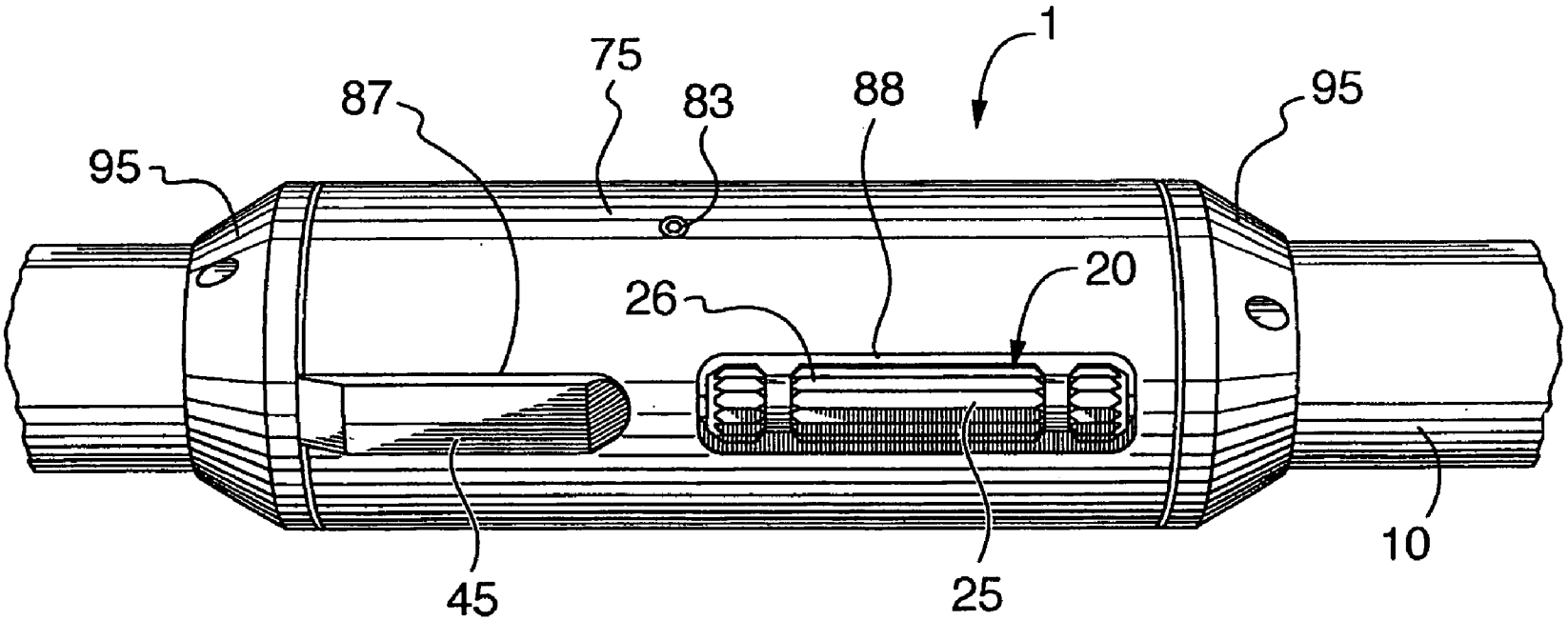
FIG. 1 is a perspective view of the torque anchor of the present invention.

Referring initially to FIG. 1, the principal components of the present torque anchor 1 include a longitudinally extending tubular mandrel 10, one or more cylindrical rotatable anchoring slip assemblies 20 that can be biassed against the well casing by the mandrel to prevent rotation of the anchor, frictional drag blocks 45 that are continuously biassed against the casing and a rotatable slip housing 75 that retains the slip assemblies and drag blocks in their operational positions.

Figure 2:
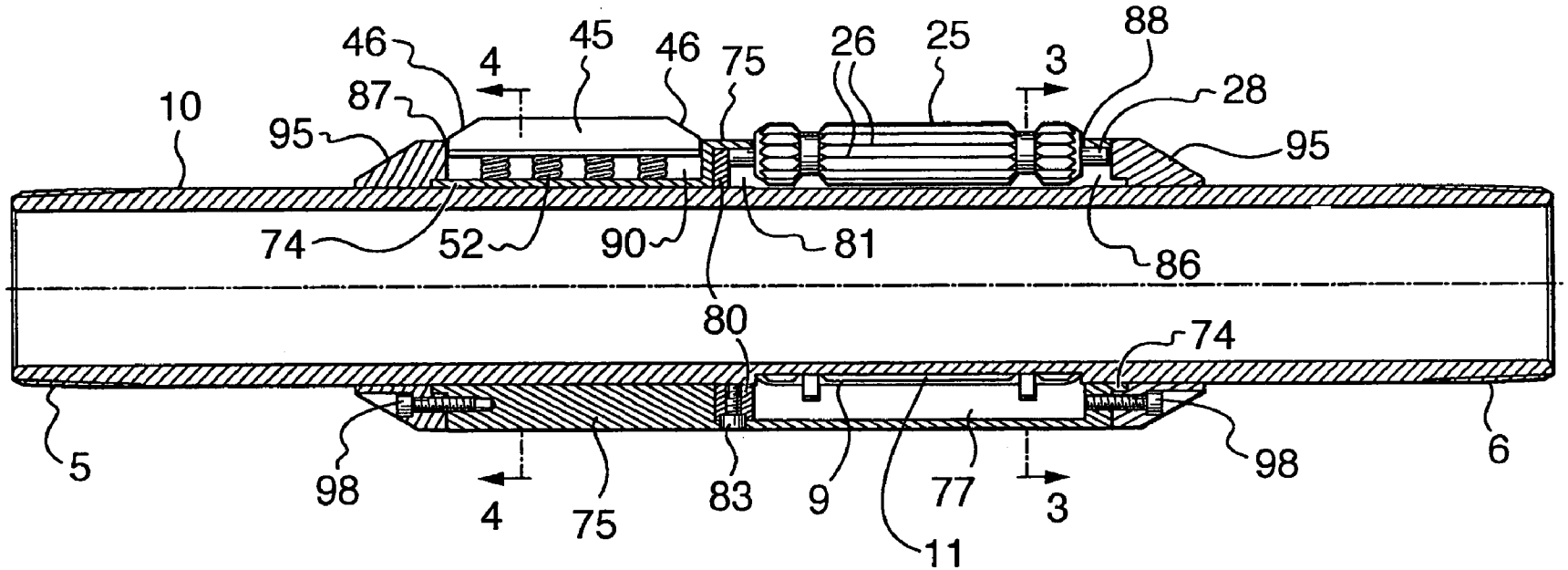
FIG. 2 is a side elevational cross-sectional view of the anchor of FIG. 1.
Figure 7:
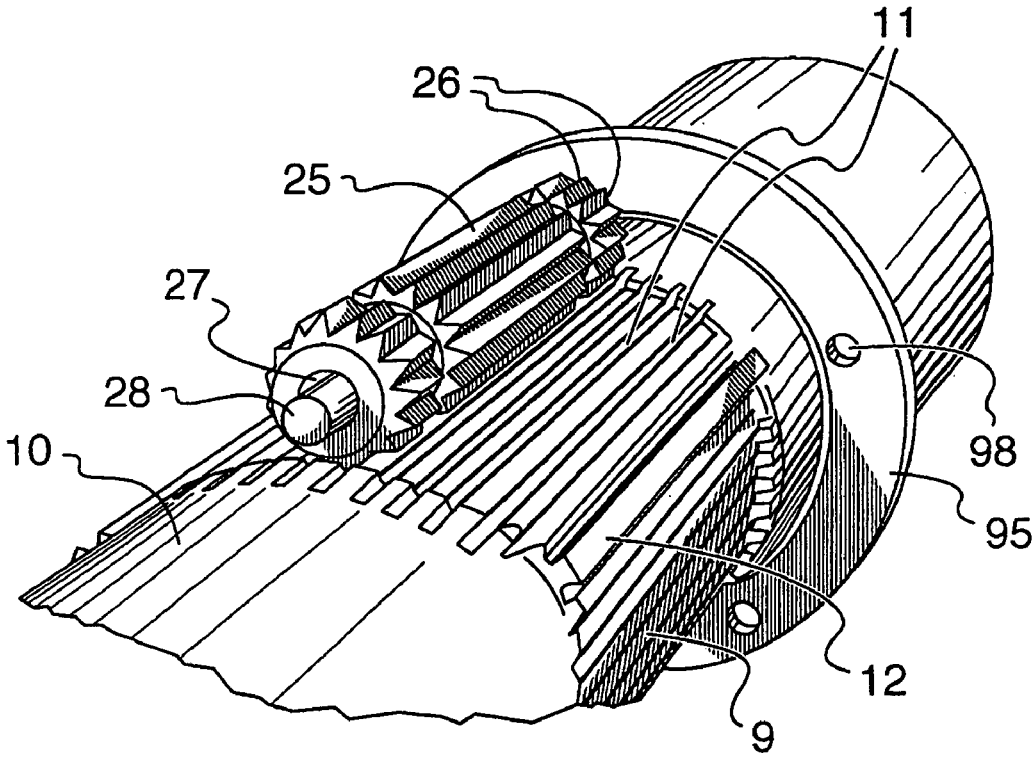
FIG. 7 is a perspective view of a center mandrel forming part of the tool of FIG. 1.

With reference to FIGS. 2 and 7, mandrel 10 is a hollow tubular member threaded at its opposite ends 5 and 6 for respective connection at one end to the stator of the progressing cavity pump (not shown), and at the other end to any tubing below the anchor (again not shown). At a point intermediate along its length the mandrel includes a section 9 serrated with longitudinally extending teeth 11 the configuration of which will be seen most clearly in FIG. 3. The cross-sectional shape of toothed section 9 is generally trochoidal including three longitudinally symmetrical lobes 12 spaced apart by webs 13. As will be seen most clearly in FIG. 3, the teeth on lobes 12 extend radially above the outer surface 8 of mandrel 10, whereas the teeth on webs 13 peak below surface 8 except where they transition into the lobes. As will be described in greater detail below, lobes 12 convert the rotating movement of mandrel 10 into linear movement of anchor slips 25 forming part of assemblies 20 to bias them against the well casing to set the anchor against rotation. The action of the lobes is therefore cam-like.

Ideally, the lobes and teeth of section 9 are machined into the mandrel's parent metal but the section can be formed as a discrete component and welded into place between sections of mandrel.

Figure 3:
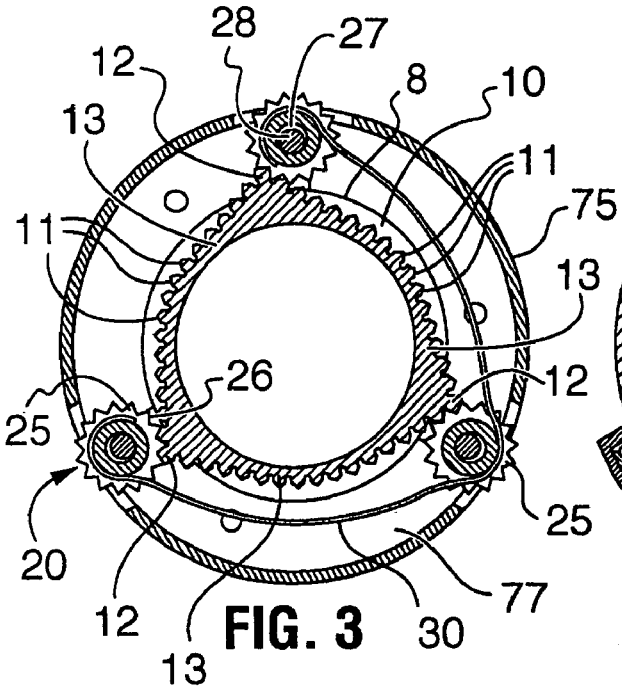
FIG. 3 is a cross-sectional view of the tool of FIG. 2 along the line 3—3.
Figure 5:
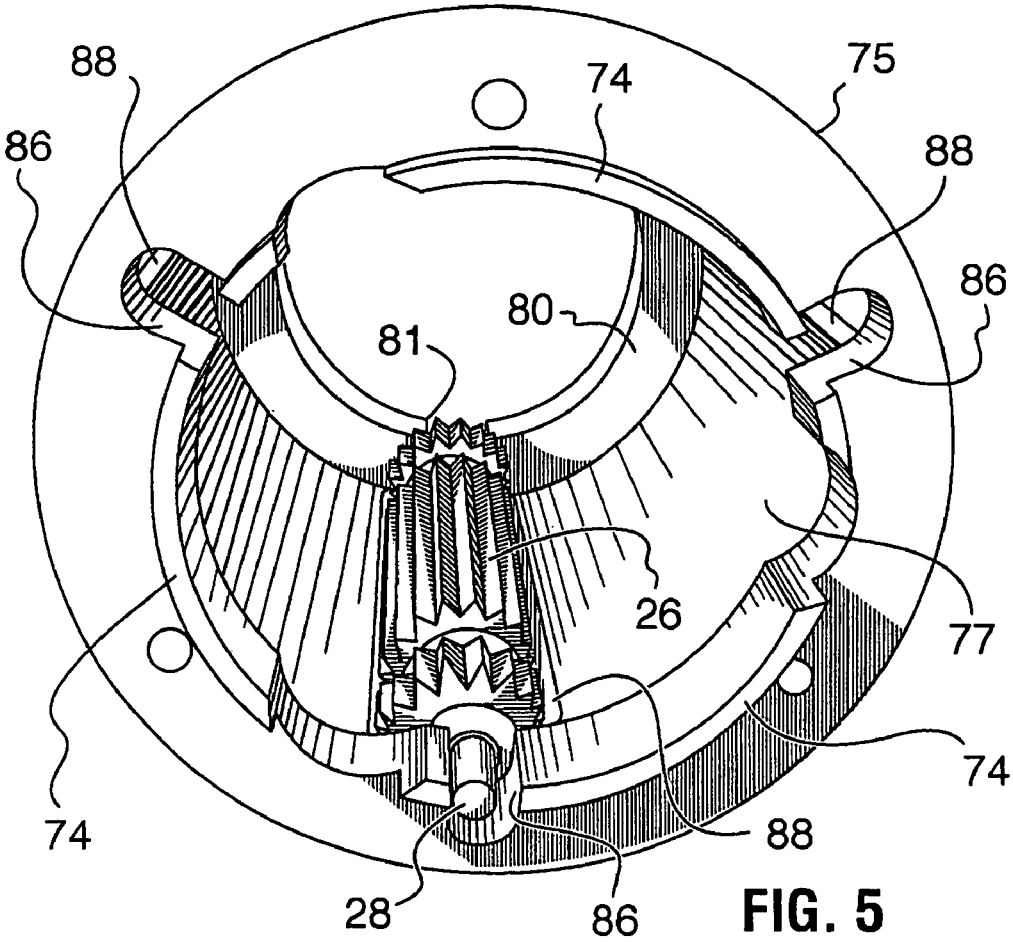
FIG. 5 is a perspective view of one end of a slip housing forming part of the tool of FIG. 1.

With reference to FIGS. 2, 3 and 5, anchor slip assemblies 20 include anchor slips 25 which are generally cylindrical in shape formed with longitudinally extending teeth 26 that extend around their entire circumference. Each slip is formed with an axially extending bore 27 therethrough to receive a spindle 28 about which the slip can rotate freely. The diameter of the bore preferably exceeds the diameter of the spindle so that there is some radial "play" between the two. This allows the slips to self-adjust a bit for small irregularities in the casing or small misalignments between the mandrel and the casing, and it also ensures that the slips can continue to rotate even if some sand or dirt works its way into bore 27. The slips can also move a bit in the axial direction of the spindles if desired.

The slip's teeth 26 are shaped to engage teeth 11 on mandrel 10. In a typical anchor, there will be as many slips 25 as there are lobes 12 on the mandrel. Although the present anchor could function with only a single slip assembly, as a practical matter there should be two or three slip assemblies and the use of more than three is also possible.

Figure 4:
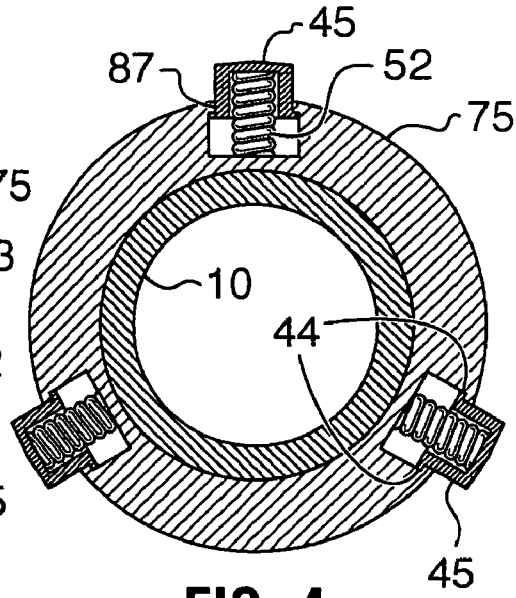
FIG. 4 is a cross-sectional view of the tool of FIG. 2 along the line 4—4.
Figure 6:
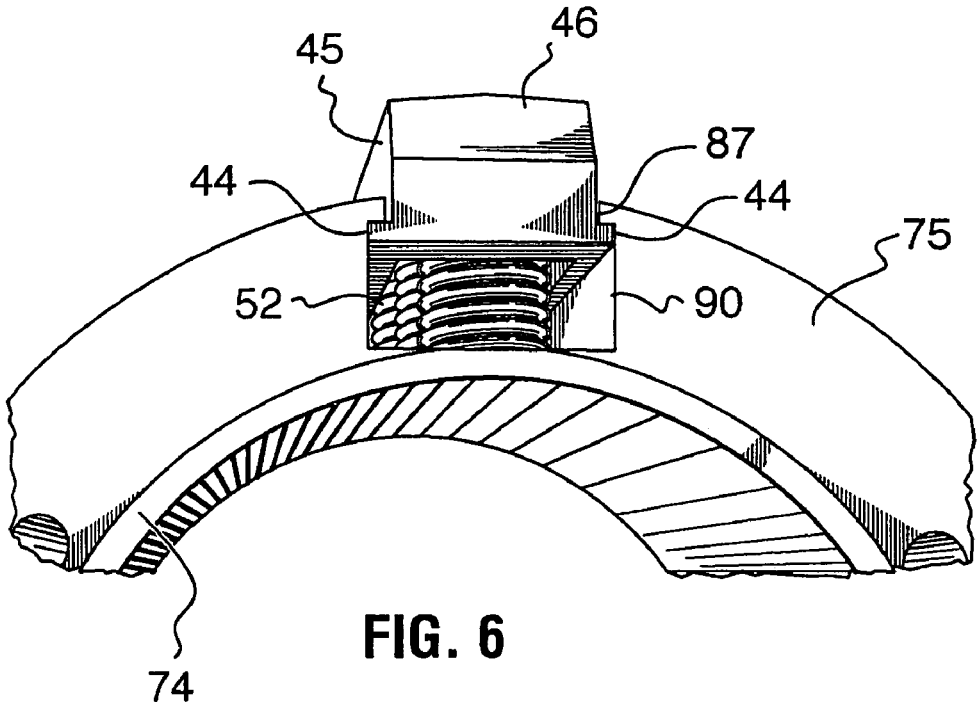
FIG. 6 is an end view of the other end of the slip housing shown in FIG. 5 with a drag block therein.

With reference to FIGS. 2, 4 and 6, the present anchor also includes at least one and more typically a plurality of drag blocks 45. Each drag block is generally rectangular in shape with champhers 46 at their opposite ends to facilitate movement of the anchor up and down through the well bore. Each drag block may be a single metal block drilled on the underside to retain springs 52 used to continuously bias the drag blocks outwardly into contact with the well casing as will be described below. Each drag block is additionally formed with longitudinally extending flanges 44 that will bear against the edges of apertures 87 in slip housing 75 to prevent the drag blocks from being completely extruded by springs 52. The embodiment shown includes three drag blocks but fewer or more can be used.

Slip assemblies 20 and drag blocks 45 are retained in place relative to mandrel 10 by slip housing assembly 75. As will be seen most clearly in FIGS. 2 and 5, slip housing 75 is cylindrical in shape for a concentric fit around mandrel 10. The end of the housing that encloses slips 25 is internally hollowed out to provide a cavity 77 for the slips, lobes 12 and spring clips 30 that can optionally be used to normally bias the slips against mandrel teeth 11.

The inner end of cavity 77 is machined out to accommodate a guide ring 80. Ring 80 is itself formed with a plurality of grooves 81 to capture the axially extending ends of spindles 28 so that they can rotate freely as well as move up and down in the grooves. A plurality of bolts 83 extending through the outer surface of housing 75 connect the ring to the housing and prevent its rotation relative to the housing. The outer end of cavity 77 is formed with axially aligned grooves 86 similar in size and shape to the grooves in ring 80 and which similarly function to capture the other ends of spindles 28 for rotation and for up and down movement.

With reference to FIGS. 2 and 6, the end of the slip housing that retains the drag blocks 45 is generally solid with the exception of rectangular notches 90 which house the drag blocks and springs 52. The width of notches 90 is substantially equal to the width of flanges 44 on the drag blocks for a reasonably close fit allowing the drag blocks to move up and down in the notches. The drag blocks will extend outwardly through apertures 87 with which they are in registry in the slip housing's outer surface. As will be seen most clearly in FIG. 6, the width of the apertures is less than the width of flanges 44 so that springs 52 don't completely extrude the drag blocks.

The outer surface of housing 75 is formed with additional apertures 88, one in registry for each of slips 25.

End caps 95 are connected to slip housing 75 such as by means of bolts 98 to close the ends of the housing and to hold the drag blocks and slips in place. When assembled, slip housing 75 and end caps 95 are free to rotate about mandrel 10. Axial movement of the slip housing relative to the mandrel is prevented by means of the major diameter of lobes 12 being greater than the inner diameter of guide ring 80 and the end 74 of housing 75.

In operation, the assembled torque anchor is connected below or occasionally above the pump and the combination is connected to the end of the production tubing and lowered into the well. When the pump is properly positioned in the well, the motor is turned on to transmit torque to the rotor via the drive rods extending down the interior of the production tubing. As the rotor begins to turn to the right, the stator also begins to turn to the right due to the friction of the rotor against the stator's internal rubber lining.

As the stator begins to turn, so too does mandrel 10. Housing 75 however remains relatively stationary due to the frictional contact between drag blocks 45 and the well casing which also assists to center the anchor in the well bore. As the mandrel rotates, lobes 12 engage the teeth on slips 25 to cam or force the slips radially outwardly until the teeth on the slips extend above the surface of the slip housing to contact and engage the inner surface of the casing by biting into the casing's metal. This stops any further rotation of the mandrel and the pump stator connected thereto. The more torque transmitted to the mandrel, the tighter the anchoring contact engagement of the slips against the casing.

If the motor stops turning the pump for any reason, the tendency will be for the unwinding rods to torque the stator to the left. When that happens, the mandrel will also turn to the left but the drag blocks will continue to hold the slip housing relatively stationary. Lobes 12 will rotate to the left but will then quickly, within a fraction of a rotation, engage slips 25 to again force them outwardly against the casing, thereby preventing any destructive counter-rotation of the pump until the stored torque in the rods is dissipated. The trochoidal cross-sectional shape of toothed section 9 assures that slips 25 will have adequate space to retract inwardly towards mandrel 10 to completely disengage the well casing. As will be appreciated, the trochoidal cross-sectional shape of section 9 and the presence of teeth or webs 13 are preferred aspects. Other shapes are possible and the teeth on the webs can be reduced or even eliminated with the key aspect being that there is sufficient space between the mandrel and housing 75 to allow the slips to back off from anchoring contact with the well casing.

If any of the teeth on the slips are worn down, the slips can be rotated at surface, until fresh teeth are exposed to the lobes and to the casing. In this way, the present anchor enjoys an extended operational life compared to conventional anchors before major redressing or replacement of parts is required. Again, because of the trochoidal shape of toothed section 9, the slips can be pulled away from mandrel 10 enough to clear the teeth on webs 13 which allows the slips to be rotated to expose fresh teeth without having to disassemble housing 75.

Although the present anchor has been described for use to prevent rotation of a progressing cavity pump, it will be appreciated that it can be used with any downhole tool, device or installation that needs to be anchored against rotation in either the clockwise or counterclockwise directions, or both.

The above-described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

We claim:

1. An anchor to inhibit rotation of a device relative to an oil well casing, comprising:

a tubular mandrel adapted for direct or indirect connection to the device;

a cylindrical housing to receive at least a portion of said mandrel concentrically therethrough, said housing being rotatable relative to said mandrel and having a plurality of circumferentially spaced apart apertures formed in an outer surface thereof;

a plurality of spaced apart anchoring slips disposed between said housing and said mandrel in registry with respective ones of said apertures in said housing's outer surface;

first biassing means associated with said mandrel for rotation therewith in the clockwise and counterclockwise directions to engage and then move respective ones of said anchoring slips radially towards and then into temporarily anchoring contact with the casing to prevent further rotation of said mandrel and the device connected thereto in each of said clockwise and counterclockwise directions; and one or mare drag block means disposed in said housing in registry with respective ones of said apertures in said housing's outer surface to extend radially outwardly therefrom, each of said drag block means being normally biassed into frictional contact with said casing to inhibit rotation of said housing relative to the casing.

2. The anchor of claim 1, wherein said first biassing means comprise spaced apart raised areas extending radially above an outer surface of said mandrel.

3. The anchor of claim 2, wherein said anchoring slips are generally cylindrical with an axial bore formed theretbrough, said slips having an outer surface with a plurality of teeth disposed circumferentially thereabout.

4. The anchor of claim 3, wherein said raised areas have a plurality of teeth thereon adapted to drivingly engage said teeth on said anchor slips.

5. The anchor of claim 4, including a spindle member extending through said axial bore in each said anchor slip, said anchor slips being freely rotatable about said spindles.

6. The anchor of claim 5, wherein the ends of each said spindle are retained in said housing for up and down movement of said anchor slips towards and away from the casing in response to rotation of said mandrel and said raised areas thereon.

7. The anchor of claim 6, wherein said teeth on said raised areas rotate said teeth on said anchor slip into biting contact with the well casing to prevent farther rotation of said anchor slips and hence of said mandrel and said device connected thereto.

8. The anchor of claim 7, wherein said raised areas are longitudinally extending lobes equi-spaced about the circumference of said mandrel.

9. The anchor of claim 8, wherein said teeth on said anchor slips and said teeth on said lobes are longitudinally coextensive.

10. The anchor of claim 9, wherein the surface of said mandrel between said lobes includes teeth for drivingly engaging said teeth on said anchor slips, said teeth peaking below said outer surface of said mandrel to facilitate movement of said anchor slips deeper into said housing and away from the casing when said slips are not biassed into contact therewith.

11. A torque anchor for use in an oil well to temporarily prevent rotation of a device connected to the anchor in both the clockwise or counterclockwise directions relative to the well casing, comprising:

a tubular mandrel operatively connected to the device to be anchored;

a plurality of casing gripping anchor members disposed in spaced apart relationship about the circumference of said mandrel;

a housing mounted concentrically around at least a portion of said mandrel to be rotatable thereon and to at least partially contain said anchor members therein, said anchor members being mounted in said housing for rotation therewith around the mandrel and for radial movement towards and away from said mandrel;

cam means on said mandrel for operatively engaging respective ones of said anchor members to bias them towards and into gripping contact with said casing upon rotation of said mandrel in one direction, and to operatively engage another of said anchor members upon rotation of said mandrel in the opposition direction, whereby gripping of the casing by said anchor members effectively stops the rotation of said mantel relative to said casing in the clockwise and counterclockwise directions; and a plurality of friction members supported by said housing normally biassed into contact with the casing to stop rotation of said housing relative to the casing.

12. The torque anchor of claim 11, wherein said anchor members are cylindrical slips having teeth on an outer surface thereof for gripping contact with the casing.

13. The torque anchor of claim 12, wherein said cam means have teeth thereon for drivingly engaging said teeth on said slips.

14. The torque anchor of claim 13, wherein said cylindrical slips each have a bore formed therethrough for a spindle member about which said slips are freely rotatable.

15. The torque anchor of claim 14, wherein said housing includes grooves therein to receive the ends of respective ones of said spindle members for up and down movement of said spindles towards and away from said mandrel.

16. The torque anchor of claim 15, wherein said friction members comprise metallic drag blocks received into respective recesses formed in said housing.

17. The torque anchor of claim 16, wherein said drag blocks are biassed into contact with the casing by means of resilient members disposed in said recesses between said housing and respective ones of said drag blocks.

18. The torque anchor of claim 17, wherein said resilient members we springs.

19. The torque anchor of claim 17, wherein said teeth on said cylindrical slips are adapted to bite into the casing for anchoring contact therewith.

20. The torque anchor of claim 13, wherein said cam means comprise raised lobes extending in the longitudinal direction of said mandrel.

21. The torque anchor of claim 20, wherein said lobes and said teeth thereon are formed integrally with said mandrel.

22. The torque anchor of claim 20, wherein said teeth on said cylindrical slips extend in the longitudinal direction of said slips to be substantially coextensive with said teeth on said lobes.

23. The torque anchor of claim 22, wherein said housing comprises a cylindrical sleeve and removeable end caps for closing the area between said mandrel and said sleeve.

24. The torque anchor of claim 23, wherein the surface of said mandrel between said lobes includes additional teeth adapted to drivingly engage said teeth on said anchor slips.

25. A method for anchoring a device against rotation in a well bore, comprising the steps of:

non-rotatably connecting the device to a mandrel disposed either above or below the device;

surrounding at least a portion of the mandrel with a cylindrical housing that is rotatable relative to said mandrel, said housing having associated therewith a first set of anchor members normally biassed into frictional contact with the well bore to hold the housing stationary relative thereto, and a second set of anchor members actuatable in response to rotation of said mandrel in each of the clockwise and counterclockwise directions for movement between a first retracted position and a second well bore gripping position, wherein gripping of the well by said second set of anchor members prevents further rotation of said mandrel and said device connected thereto in each of the clockwise and counterclockwise directions.

26. The method of claim 25, wherein said mandrel has cam members thereon to drivingly engage respective ones of said second set of anchor members for moving them into said well gripping position thereof.

* * * * *